United States Patent [19]

Boudreau et al.

[11] 4,239,255

[45] Dec. 16, 1980

[54] SKI ATTACHMENT

[76] Inventors: Ronald B. Boudreau, Patterson Rd., Shirley, Mass. 01464; John P. Crossin, 69 Peabody Dr., Stowe, Mass. 01775

[21] Appl. No.: 973,853

[22] Filed: Dec. 28, 1978

[51] Int. Cl.[3] ..... A63C 7/10

[52] U.S. Cl. ..... 280/605

[58] Field of Search ..... 280/605, 604, 11.37 G

[56] References Cited

U.S. PATENT DOCUMENTS

| | | | |
|---|---|---|---|
| 2,077,660 | 4/1937 | Barieau | 280/604 |
| 2,107,363 | 2/1938 | Binder | 280/604 |
| 2,316,252 | 4/1943 | Karlsson | 280/605 |
| 2,595,586 | 5/1952 | LaPointe | 280/604 X |
| 2,756,063 | 7/1956 | Mercier | 280/605 X |
| 3,582,101 | 6/1971 | Ste-Marie | 280/11.37 G |
| 3,909,024 | 9/1975 | Salomon | 280/605 |

FOREIGN PATENT DOCUMENTS

| | | | |
|---|---|---|---|
| 845419 | 5/1939 | France | 280/605 |
| 27154 | 7/1916 | Norway | 280/605 |
| 471586 | 6/1969 | Switzerland | 280/605 |

*Primary Examiner*—John J. Love
*Assistant Examiner*—Milton L. Smith
*Attorney, Agent, or Firm*—Norman S. Blodgett; Gerry A. Blodgett

[57] ABSTRACT

Attachment for application to a ski to prevent the skier from sliding rearwardly when standing on a sloped surface, the attachment including a pawl which is movable from an operative position in which it lies outside the ski to an inoperative storage position on top of the ski.

5 Claims, 8 Drawing Figures

Fig. 1
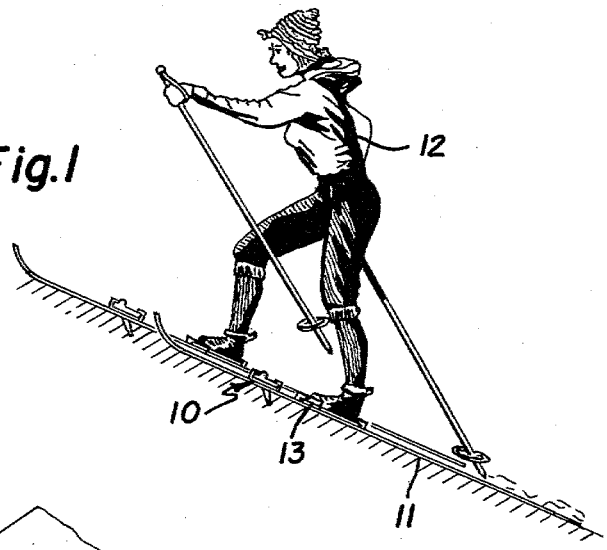
Fig. 2
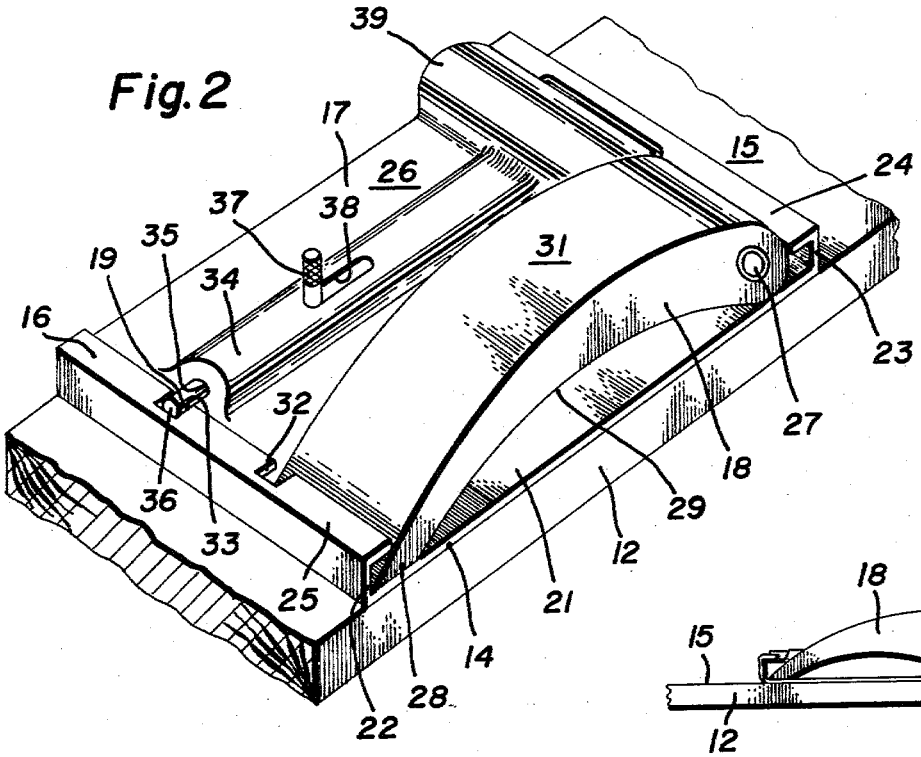
Fig. 3
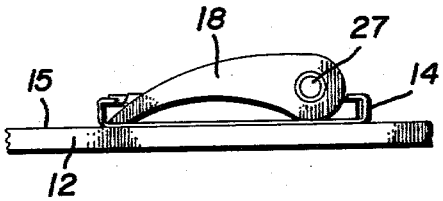
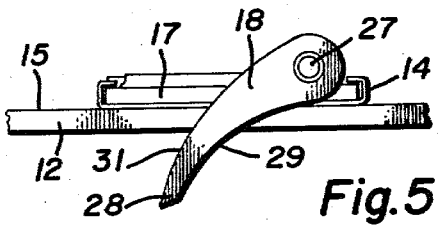
Fig. 5

SKI ATTACHMENT

BACKGROUND OF THE INVENTION

One of the more disagreeable aspects of snow skiing is that of waiting in line for the ski lift. Although the lift may consist of a chair lift, a T-bar, a J-bar, or a rope tow, they all have one thing in common and that is the "lift line". This is the column of skiers waiting one-behind-the-other to use the lift, each skier advancing slowly along the queue toward the loading point of the lift. Such a lift can become quite long and over irregular ground; the snow becomes packed and frozen, so that it is very slippery. At a particular point in time, the skier may be located on an upwardly-sloping stretch of ground. He then has a tendency to slide rearwardly and become entangled in the skis and other apparatus of the skiers behind him. This is particularly true when the lift line is very crowded and the skiers are spaced closely together, so that the individual skier cannot use his poles properly. This dangerous situation is accentuated where two portions of a lift line come together and while the skier is attempting to manuever around a turn in a sinuous lift line. These and other difficulties experienced with the prior art devices have been obviated in a novel manner by the present invention.

It is, therefore, an outstanding object of the invention to provide a ski attachment operative effectively to prevent rearward sliding of a skier on a slippery, inclined surface.

Another object of this invention is the provision of a ski attachment that is useful in an icy lift line to inhibit rearward movement of the skier.

A further object of the present invention is the provision of a ski attachment to prevent embarrassment, damage to property, and personal injury to a skier in a ski lift line due to slipping and falling.

It is another object of the instant invention to provide a ski attachment, including an anti-slippage pawl which, when stored on the upper part of the ski in inoperative position, does not interfere with normal skiing activity.

A still further object of the instant invention is the provision of a ski attachment which is simple in construction, which is inexpensive to manufacture, and which is capable of a long life of useful service with a minimum of maintenance.

It is a further object of the invention to provide a ski attachment in the form of a non-slip pawl with storage means which is not rendered inoperative by the accummulation of snow and ice.

It is a still further object of the present invention to provide an anti-slide ski attachment which, when in inoperative storage condition, has a low profile, so that it not only has a pleasing appearance, but is free from sharp edges that could cause injury.

With these and other objects in view, as will be apparent to those skilled in the art, the invention resides in the combination of parts set forth in the specification and covered by the claims appended hereto.

SUMMARY OF THE INVENTION

In general, the invention consists of a ski attachment, including a base attached to the upper surface of the ski and formed with a transverse track. A movable element is slidably carried in the track for movement transversely of the ski. A pawl is pivotally mounted on the movable element and a detent is provided for selectively locking the movable element either in an inoperative position in which the pawl lies over the ski, or in an operative position in which the pawl lies outside the ski.

More specifically, the base consists of a rectangular plate fastened to the ski and having spaced, parallel, transverse sides. The track is formed of upstanding walls along the transverse sides terminating in inwardly-directed flanges. The movable element consists of a generally rectangular plate whose edges fit snugly under the flanges for transverse sliding, the element having a width which is less than the width of the ski by an amount at least equal to the width of the pawl. A pivot pin extends through the pawl and the movable element at their forward ends and the rearward end of the pawl is provided with a point adapted to slide under the flange at that end when the pawl is in the inoperative position. The detent is slidable on the movable element in a longitudinal direction and the rearward flange of the base is provided with two notches corresponding to the two positions of the pawl.

BRIEF DESCRIPTION OF THE DRAWINGS

The character of the invention, however, may be best understood by reference to one of its structural forms, as illustrated by the accompanying drawings, in which:

FIG. 1 is a perspective view showing a ski attachment constructed in accordance with the principles of the present invention in use with a ski, FIG. 2 is an enlarged perspective view of the ski attachment, FIG. 3 is a side elevational view of the attachment in storage mode, FIG. 5 is a side elevational view of the attachment in operative mode.

DESCRIPTION OF THE PREFERRED EMBODIMENT

Figure 4:
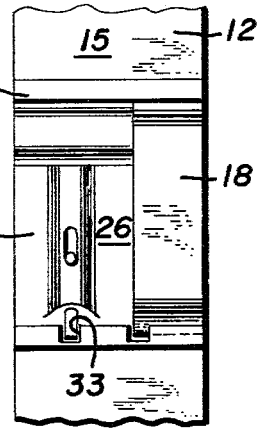
FIG. 4 is a plan view of the attachment in storage mode.
Figure 6:
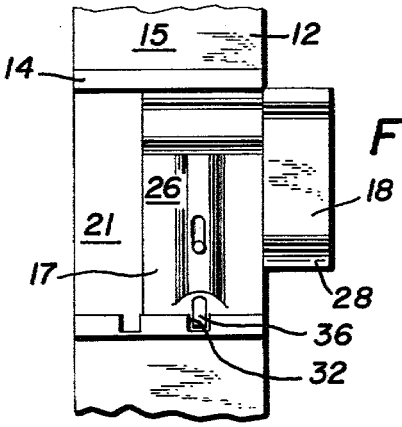
FIG. 6 is a plan view of the attachment in operative mode.

Referring first to FIG. 1, wherein are best shown the general features of the invention, the ski attachment, indicated generally by the reference numeral 10, is shown as located on the ski 11 forwardly of the binding 13 by which the boot of the skier 12 is attached to the ski. For the purpose of illustration, the skier is shown as progressing up a slight incline of the type typically found in a ski lift.

In FIG. 2 it can be seen that the ski attachment 10 is mounted on the upper surface 15 of the ski 12. For the purposes of the present discussion, the expression "forward" and "rearward" and "transverse" refer to those expressions as normally used in connection with a snow ski.

The attachment includes a base 14 attached to the upper surface 15 of the ski 12, the base having a track 16 extending laterally thereof and transversely of the ski. A movable element 17 is carried in the track 16 for movement across the ski. A pawl 18 is pivotally mounted on the movable element 17 and a detent 19 is provided for selectively locking the movable element either in an inoperative position (as shown in FIG. 2), wherein the pawl lies over the ski, or an operative position, wherein the pawl lies outside the ski.

The base 14 consists of a rectangular plate 21 fastened to the ski by screws in the usual way and the track 16 consists of end walls 22 and 23, extending upwardly at a right angle from each of the two opposed transverse end edges of the plate 21. The end wall 23 is located at the forward edge and the end wall 22 is located at the rearward edge. Horizontal flanges 24 and 25 extend horizontally and inwardly from the upper edges of each end wall 23 and 22, respectively. The movable element 17 consists of a generally retangular plate 26 that extends between the said end walls 22 and 23 and fits snugly under the flanges 24 and 25, the element having a width less than the width of the ski 12 by a selected amount. The pawl 18 has a thickness in the transverse direction of the ski which is equal to the said selected amount, so that, when the movable element 17 and the pawl 18 lie in the inoperative position shown in the drawing, they occupy substantially the full width of the ski. A pivot pin 27 extends horizontally through one end of the pawl 18 and through the movable element 17 adjacent the forward end of the base 14. The rearward end of the pawl 18 is provided with a point 28 and the pawl is of a generally arcuate form with a concave undersurface 29 facing downwardly and a convex surface 31 facing upwardly. The point 28 at the rear end of the pawl lies under the flange 25 when the pawl is in the storage position.

The detent 19 is slidable on the movable element 17 and the flange 25 is provided with two notches 32 and 33 corresponding to the operative and inoperative positions, respectively, of the equipment. The pawl 18 is spring-biased to press the point end downwardly against the base when the movable element and the pawl are in the inoperative position and downwardly against the snow and ice when they are in the operative position. The movable plate 17 is provided with a longitudinal ridge 34 having a bore 35 extending lengthwise thereof. The detent consists of a pin 36 slidable in the bore and a finger 37 extending upwardly and through a longitudinal slot 38 in the ridge. A spring (not shown) lies in the bore and biases the spring outwardly into the notches 32 and 33. The pivot pin 27 lies in a bore extending longitudinally of a transverse ridge 39 formed on the movable element and a torque spring lies in the same bore to produce the downward biasing of the pawl 18.

The operation and the advantages of the present invention will now be readily understood in veiw of the above description. In FIGS. 3 and 4, the apparatus is shown in the inoperative mode in which the pin 36 of the detent 19 lies in the notch 33. The pawl 18 lies on the upper surface of the plate 21 and its point 28 lies snugly under the flange 25. As is particularly evident in FIG. 3, the attachment has a low profile that presents no dangerous edges to cause the skier any problem. In this condition the skis are ready for use and the skier uses them to ski in the usual way. After he has finished skiing and approaches the lift line, he operates the finger 37 to withdraw the pin 36 from the notch 33 and presses the movable element 17 laterally. The movable element 17 and the pawl 18 move sideways until the pin 36 enters the notch 32 at which time the pawl 18 is entirely outside of the upwardly projected area of the ski and, due to its spring bias, moves downwardly, pivoting about the pivot pin 27. When the skier moves forwardly, the pawl simply cams over the irregularities in the snow and ice in the lift line and presents very little resistance to his forward motion. When he stops, however, the point engages the ice and any rearward movement will cause the point to bite into the snow and ice and prevent rearward motion. In this way, the skier can stand on a relatively inclined, icy slope without danger of slipping rearwardly, falling down, or causing himself embarrassment or injury. When the skier arrives at the lift, he can leave the apparatus in its operative condition, if he wishes. During the ride up on the lift, he can move it laterally, so that the detent is in operative engagement with the notch 33 again and the attachment is ready for conventional skiing.

It can be seen, then, that the present invention provides an attachment that not only has a pleasing appearance, but presents no obstacles to ordinary skiing. It is simple and open in construction and, therefore, will not be rendered inoperative by snow and ice. The device is also useful in down hill skiing when one has to walk up a section of the trail to retrieve a dropped pole or in progressing from the ski area to a lodge or vice versa. Normally, one of the attachments would be provided for each of the two skis. In this way, one attachment would be holding while the other was being moved, thus insuring safe and steady progress.

Figure 7:
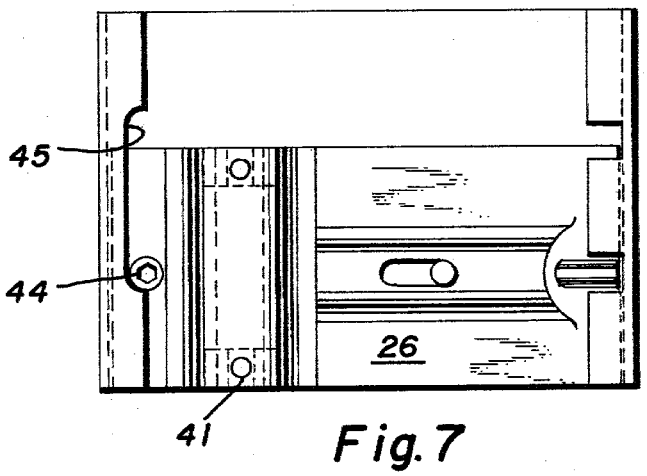
FIG. 7 is an enlarged plan view of a portion of the attachment.
Figure 8:
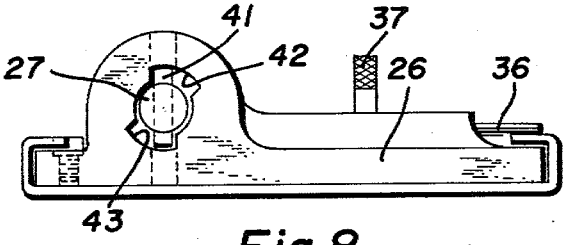
FIG. 8 is a side elevational view of the apparatus.

Referring to FIGS. 7 and 8, in order to prevent the pawl 18 from swinging freely around the pivot when pressure is applied, a roll pin 41 is placed in the pivot pin 27. This is done after the pivot pin is in the plate 39. Limiting recesses 42 and 43 are formed in the plates to limit pivot pin rotation (and pawl swing) by engagement of the roll pin 41 with the surface of the recesses. Also, to keep the plate from leaving the base 14 entirely, a set screw 44 is provided that engages the ends of a recess 45 formed in the edge of the flange 24 of the base 14. This screw is also inserted after the initial assembly of the parts.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Ski attachment, comprising:

(a) a rectangular base plate adapted to be fastened to the upper surface of a ski and having a track at each transverse end, each of said tracks consisting of a vertical end wall and a flange extending horizontally and inwardly from the upper edge of the vertical wall, (b) a generally rectangular movable plate extending between the said end walls and fitting snugly under the flanges for sliding movement transversely of the ski between an operative position and an inoperative position, said movable plate having a width which is a selected amount less than the width of the ski, (c) a pawl having a thickness in the transverse direction of the ski which is generally equal to said selected amount, one end of said pawl being mounted on the movable plate for pivotal movement about a horizontal axis adjacent the forward end of the base, and the other end of the pawl lying over the base plate and under the flange of the rearward flange when the movable plate is in the inoperative position, so that the pawl is prevented from pivoting about said horizontal axis, said pawl lying outside of the ski and the rearward flange when the movable plate is in the operative position, so that the pawl is free to pivot about said horizontal axis, (d) a detent for selectively locking the movable element against transverse sliding in either said inoperative position or said operative position, and (e) means for biasing said other end of the pawl against the base plate when the movable plate is in said inoperative position and for biasing said other end against the ground when the movable plate is in said operative position.

2. Ski attachment as recited in claim 1, wherein the other end of the pawl is pointed, and the pawl is generally arcuate with a concave surface facing downwardly and a convex surface facing upwardly.

3. Ski attachment as recited in claim 1, wherein the said detent is slidable on the movable plate and one of said flanges is provided with two notches corresponding to the said operative and inoperative positions.

4. Ski attachment as recited in claim 3, wherein the movable plate is provided with a longitudinal ridge having a bore extending lengthwise, the detent consisting of a pin sliding in the bore and a finger extending upwardly through a longitudinal slot in the ridge, a spring lying in the bore and biasing the pin outwardly into the notches.

5. Ski attachment as recited in claim 1, wherein a transverse ridge is formed on the movable plate and is provided with a longitudinal bore, and a pivot pin extends through said one end of the pawl and into said bore.

* * * * *